US008790070B2

(12) United States Patent
Klingner et al.

(10) Patent No.: US 8,790,070 B2
(45) Date of Patent: Jul. 29, 2014

(54) STATOR-ROTOR ARRANGEMENT FOR A VACUUM PUMP AND VACUUM PUMP

(75) Inventors: Peter Klingner, Cologne (DE); Markus Henry, Cologne (DE)

(73) Assignee: Oerlikon Leybold Vacuum GmbH, Cologne (DE)

( * ) Notice: Subject to any disclaimer, the term of this patent is extended or adjusted under 35 U.S.C. 154(b) by 765 days.

(21) Appl. No.: 13/059,758

(22) PCT Filed: Aug. 25, 2009

(86) PCT No.: PCT/EP2009/060918

§ 371 (c)(1),
(2), (4) Date: Feb. 18, 2011

(87) PCT Pub. No.: WO2010/023200

PCT Pub. Date: Mar. 4, 2010

(65) Prior Publication Data

US 2011/0150629 A1 Jun. 23, 2011

(30) Foreign Application Priority Data

Aug. 28, 2008 (DE) ..... 20 2008 011 489 U

(51) Int. Cl.
*F04D 3/00* (2006.01)

(52) U.S. Cl.
USPC ..... 415/55.1; 415/55.5; 415/55.6

(58) Field of Classification Search
USPC ..... 415/55.1, 55.2, 55.5, 55.6, 55.7, 90; 416/198 R, 198 A, 203
See application file for complete search history.

(56) References Cited

U.S. PATENT DOCUMENTS

| | | | | |
|---|---|---|---|---|
| 2,247,335 | A * | 6/1941 | Neibert | 415/55.4 |
| 2,340,787 | A * | 2/1944 | Zenner et al. | 415/100 |
| 2,455,460 | A * | 12/1948 | Zenner | 415/104 |
| 2,933,129 | A * | 4/1960 | Wright | 60/39.281 |
| 3,135,215 | A * | 6/1964 | Smith | 415/99 |
| 3,168,978 | A | 2/1965 | Garnier et al. | |
| 4,118,847 | A * | 10/1978 | Mansson et al. | 29/889.2 |
| 5,531,564 | A * | 7/1996 | Anttonen et al. | 415/104 |
| 6,457,954 | B1 | 10/2002 | Adamietz et al. | |
| 6,461,123 | B1 * | 10/2002 | Lotz | 417/423.4 |
| 6,561,755 | B1 * | 5/2003 | Lotz et al. | 415/90 |
| 6,840,736 | B2 * | 1/2005 | Ohtachi et al. | 415/90 |
| 7,500,821 | B2 * | 3/2009 | Watz | 415/90 |
| 2003/0103842 | A1 * | 6/2003 | Nonaka et al. | 415/90 |
| 2005/0214109 | A1 * | 9/2005 | Grande et al. | 415/90 |

FOREIGN PATENT DOCUMENTS

| | | | |
|---|---|---|---|
| EP | 1096152 | A2 | 5/2001 |
| EP | 1101944 | A2 | 5/2001 |
| EP | 1090231 | B1 | 10/2005 |

* cited by examiner

*Primary Examiner* — Edward Look
*Assistant Examiner* — Aaron R Eastman
(74) *Attorney, Agent, or Firm* — Fay Sharpe LLP

(57) ABSTRACT

A stator-rotor arrangement for a vacuum pump, in particular for a turbomolecular pump, includes a plurality of stator disks (18) that cooperate with a rotor element (14). The stator disks (18) are disposed between rotor disks (16). The stator disks (18) are held by way of stator rings (20, 22). At least two of the stator rings (20) include protrusions (24) that are connected together by way of holding elements (28, 30). This makes pre-installation of the rotor-stator arrangement (12) or placement of the rotor-stator arrangement (12) in a housing (10) possible. The protrusions (24) are disposed in the area of corners (32) of the housing (10).

20 Claims, 1 Drawing Sheet

STATOR-ROTOR ARRANGEMENT FOR A VACUUM PUMP AND VACUUM PUMP

BACKGROUND

The invention relates to a stator-rotor arrangement for vacuum pumps, in particular for turbomolecular pumps.

Vacuum pumps, such as turbomolecular pumps, comprise a rotor element surrounded by stator disks. In this arrangement, the stator disks extend between the individual rotor disks of the rotor element, with the stator disks being usually formed as half rings. In the longitudinal direction of the rotor, which normally corresponds to the pumping direction, the stator disks are arranged in series in alternate arrangement with rotor disks. For fixation of the stator disks, stator rings are provided. A stator disk is held in a form-closed manner by respectively two adjacent stator rings. Thus, the stator rings are stacked onto each other. For assembly, two half disks forming a stator disk will have to be arranged alternately with annular stator rings surrounding the stator element, whereupon the stator-rotor arrangement will be inserted into a housing comprising a cylindrical recess. Consequently, the assembly process is extremely bothersome.

From U.S. Pat. No. 6,457,954, it is known to arrange the rotor element together with the stator disks and the stator rings in a cylindrical cartridge. This cartridge will then be arranged in the housing. In this manner, the stator-rotor arrangement can be pre-assembled within said cartridge. In order to realize such a pre-assembly, however, an additional component in the form of said cartridge is required.

It is an object of the invention to provide a stator-rotor arrangement which can be pre-assembled in a simple manner.

SUMMARY

In the stator-rotor arrangement of the invention, at least two of the stator rings each comprise at least two protrusions, bulges, projections or lugs. Said at least two stator rings are connected to each other at the protrusions by means of a holding element. By the connection of at least two stator rings via holding elements, there is achieved a fixation of all further stator rings and stator disks arranged between said two stator rings. It is thus rendered possible to pre-assemble at least two and preferably more stator rings and a corresponding number of stator disks together with the rotor element. Said fixation via the holding elements will result in a pre-assembled unit which then can be simply inserted into the pump housing. Thereby, the assembly process will be considerably facilitated.

Preferably, at least the two outer stator rings each comprise at least two protrusions. Thus, all stator disks arranged between the two outer stator rings are fixed by the two outer stator rings which are connected to each other via the holding elements.

The holding elements can be tensioning elements, e.g. screws, so that, for fixing the stator rings and stator disks arranged between said two outer stator rings, the two outer stator rings can be tightened toward each other.

Preferably, the protrusions are formed with openings through which the preferably rod-shaped holding element is guided. The holding element herein preferably is a screw, a threaded bar or the like.

For guaranteeing an optimally uniform force transmission onto the stator rings and for avoiding a tilting of the stator rings relative to each other during assembly, those stator rings which comprise protrusions preferably have at least three and most preferably four of such protrusions. The protrusions are preferably arranged on the circumference of the stator ring in an evenly distributed manner. Thus, if three protrusions are provided, these are arranged at an angle of 120° relative to each other and, if four protrusions are provided, these are arranged at an angle of 90° relative to each other.

It is particularly preferred that not only the two outer stator rings but a larger number of stator rings, particularly all stator rings, comprise respectively at least two protrusions. Optionally, the protrusions of adjacent stator rings can also be offset relative to each other so that, for instance, only the protrusions of each second stator ring are connected to each other.

By the inventive provision of protrusions for attachment to the holding elements, the stator rings can be given a smaller width and particularly a minimal width between the protrusions. The width of the stator rings between the protrusions can be selected in a similar manner as in known stator rings because, in this area, the stator rings merely must have the required stiffness for holding the stator disks with positional accuracy.

The invention further relates to a vacuum pump, particularly a turbomolecular pump, comprising a housing in which a preferably pre-assembled stator-rotor arrangement as described above is arranged. It is particularly preferred herein that the stator-rotor arrangement has a substantially cylindrical basic shape, wherein the protrusions and the holding elements connecting the protrusions to each other are projecting from said cylindrical basic shape in outward directions. The preferably pre-assembled stator-rotor arrangement is arranged in a rectangular, preferably square pump housing. It is preferred that the protrusions as well as the holding elements are arranged in the corners of the pump housing. The protrusions and holding elements are thus located in a region of the pump housing that otherwise is a dead space. This offers the advantage that, in spite of the provision of protrusions on the stator rings, the pump housing does not have to be enlarged. It is thus possible, while maintaining a small constructional volume, to accommodate a pre-assembled stator-rotor arrangement in a relatively small pump housing. Particularly, it is possible to place the inventive stator-rotor arrangement into existing, unmodified pump housings. This is of advantage also in comparison to the provision of a cartridge because the cartridge would fully surround the stator rings, with the resultant need for a larger pump housing.

BRIEF DESCRIPTION OF THE DRAWINGS

The invention may take form in various components and arrangements of components, and in various steps and arrangements of steps. The drawings are only for purposes of illustrating the preferred embodiments and are not to be construed as limiting the invention.

In the drawings, the following is shown.

DETAILED DESCRIPTION

Figure 1:
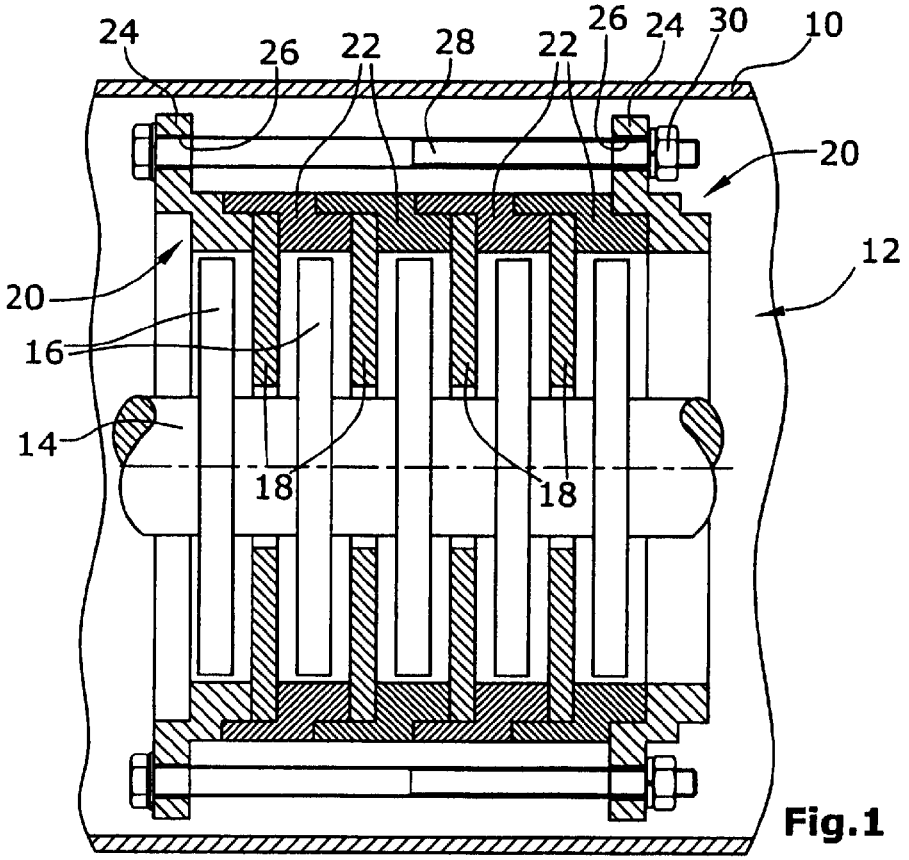
FIG. 1 is a schematic longitudinal sectional view of a stator-rotor arrangement according to the invention as arranged in a pump housing.

In a pump housing 10, a stator-rotor arrangement 12 is disposed, wherein said pump housing 10 has a substantially square cross section in the region of the stator-rotor arrangement 12 and respectively along the length of the latter.

Said stator-rotor arrangement comprises a rotor element 14 with annular rotor disks 16, said rotor element preferably being formed as one piece. Between said rotor disks 16, stator disks 18 are arranged which e.g. include respectively two half rings. Said stator disks 18 are held by stator rings 20, 22. In the illustrated embodiment, identically formed stator rings 22 are arranged between two outer, again identically formed stator rings 20. It can also be provided that all stator rings are formed corresponding to the stator rings 20 according to the invention.

In the illustrated embodiment, said two outer stator rings 20 are provided with four protrusions 24. Each protrusion 24 has an opening 26. Fitted through said openings 26 is a holding element 28 which in the illustrated embodiment is formed as a bolt or machine screw and which is fixed by a nut 30. Instead of providing a nut 30, an internal thread can be formed in the opening 26. It is thus possible to sequentially place the individual stator rings 20, 22 and the stator disks 18 arranged between the rotor disks 16, and to fix them by use of the holding element 28, 30. In this manner, a stator-rotor arrangement can be pre-assembled which then will be inserted into the housing 10.

Figure 2:
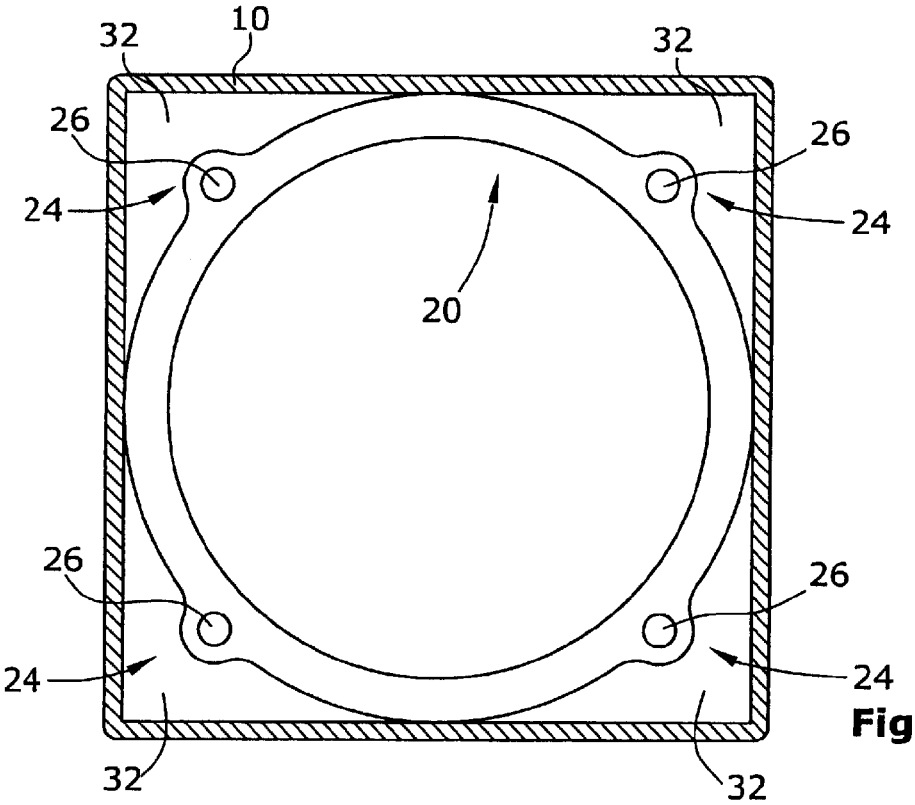
FIG. 2 is a schematic plan view of a stator ring according to the invention as arranged in a square housing.

As evident particularly from FIG. 2, the protrusions 24 are arranged in corners 32 of the housing. Thereby, it is rendered possible to provide a housing 10 having relatively small outer dimensions and nonetheless to use a preassembled stator-rotor arrangement.

A further simplification of the assembly process can be realized by providing also all stator rings 22 with protrusions 24. Depending on the given case, this makes it also possible, during the assembly process, to mount the stator rings onto vertically upright threaded bolts 28 so that the position of the stator rings will be immediately fixed.

The invention has been described with reference to the preferred embodiments. Modifications and alterations may occur to others upon reading and understanding the preceding detailed description. It is intended that the invention be construed as including all such modifications and alterations insofar as they come within the scope of the appended claims or the equivalents thereof.

The invention claimed is:

1. A stator-rotor arrangement for a turbomolecular pump, comprising a plurality of stator disks cooperating with rotor disks of a rotor, said stator disks being serially disposed in the longitudinal direction of the rotor, and a plurality of stator rings including inner and outer stator rings with the inner stator rings between the outer stator rings, the outer stator rings extending circumferentially around an outer circumference of the stator disks, pairs of adjacent inner stator rings holding one of the stator disks between adjacent rotor disks, wherein at least two of the outer stator rings comprise respectively at least two protrusions and that said at least two stator rings are connected to each other at the protrusions by a holding element.

2. The stator-rotor arrangement according to claim 1, wherein the protrusions of only the two outer stator rings are connected to each other by the holding element.

3. The stator-rotor arrangement according to claim 1, wherein the protrusions comprise openings, with the holding element guided through said openings, the holding element being rod-shaped.

4. The stator-rotor arrangement according to claim 1, wherein at least three protrusions are provided on at least two of the outer stator rings, said protrusions being arranged on the circumference of the outer stator rings.

5. The stator-rotor arrangement according to claim 4, wherein there are at least four protrusions.

6. The stator-rotor arrangement according to claim 4, wherein the protrusions are evenly distributed on the circumference of the outer stator rings.

7. The stator-rotor arrangement according to claim 1, wherein each outer stator ring comprises at least two protrusions.

8. The stator-rotor arrangement according to claim 1, wherein the holding element includes a tensioning screw.

9. The stator-rotor arrangement according to claim 1, wherein along a circumferential direction, the outer stator rings have a reduced circumference between the protrusions.

10. A vacuum pump, particularly a turbomolecular pump, comprising:

the stator-rotor arrangement according to claim 1 arranged inside of a housing;

wherein the protrusions of the stator-rotor arrangement, have a substantially cylindrical basic form and are arranged in corners of the housing, which is rectangular at least in a region of the stator-rotor arrangement.

11. The stator-rotor arrangement according to claim 1, wherein each stator disk includes two half disks.

12. The stator-rotor arrangement according to claim 11, wherein the stator rings having an inner diameter that is larger than an outer diameter of the rotor disks such that the stator rings can pass over the rotor disks;

wherein each inner stator ring has end faces on opposite sides, the two half disks of one of the stator disks being supported between the end faces of adjacent stator rings.

13. The stator-rotor arrangement according to claim 12, wherein each inner stator ring has a circumferential extension on one side which circumferentially surrounds supported stator disk halves.

14. The stator-rotor arrangement according to claim 13, wherein the rotor is formed as one piece.

15. A turbomolecular vacuum pump comprising:

a stator-rotor arrangement arranged in a housing, the stator-rotor arrangement comprising:

a plurality of stator disks cooperating with rotor disks of a rotor, said stator disks being serially disposed in a longitudinal direction of the rotor to pump gas longitudinally along the rotor, a plurality of stator rings including inner and outer stator rings and extending circumferentially around the stator disks, adjacent inner stator rings holding one of the stator disks therebetween to position the one of the stator disks between an adjacent pair of the rotor disks, the outer stator rings including at least two protrusions, and a holding element which connects said outer stator rings to each other at the protrusions.

16. The vacuum pump according to claim 15, wherein the stator disks are formed as half disks with each stator disk including two half disks.

17. The vacuum pump according to claim 16, wherein the rotor includes a shaft and the rotor disks, the shaft and rotor disks being formed as one piece.

18. The vacuum pump according to claim 15, wherein inner stator rings have:

a larger inner diameter than an outer diameter of the rotor disks, side faces that abut side portions of the stator disks, and a circumferential extension that circumferentially surrounds one of the stator disks.

19. The vacuum pump according to claim 15, wherein the inner stator rings have a reduced circumferential dimension relative to the protrusions.

20. A vacuum pump comprising:

a rotor having a plurality of rotor disks;

a plurality of stator disks interleaved with the rotor disks;

a plurality of stator rings which hold the stator disks together in a stack, at least two of the stator rings having four protrusions which define openings therein;

a plurality of rod-like holding elements which extend through one of the openings in each of the at least two stator rings and hold the at least two stator rings and the plurality of stator disks together in the stack; and a rectangular housing, the stack being disposed within the rectangular housing with the protrusions in corners of the housing.

* * * * *